United States Patent [19]

Trauner et al.

[11] 4,104,640

[45] Aug. 1, 1978

[54] STEERABLE ANTENNA ARRANGEMENT

[75] Inventors: Gerhard Trauner; Michael Kiripolszki, both of Vienna, Austria

[73] Assignee: Vereinigte Osterreichische Eisen-und Stahlwerke - Alpine Montan Aktiengesellschaft, Linz, Austria

[21] Appl. No.: 801,600

[22] Filed: May 31, 1977

[30] Foreign Application Priority Data

Jun. 11, 1976 [AT] Austria ..... 4253/76

[51] Int. Cl.[2] ..... H01Q 3/08

[52] U.S. Cl. ..... 343/765

[58] Field of Search ..... 343/763, 765, 766, 912, 343/915

[56] References Cited

U.S. PATENT DOCUMENTS 3,787,870 1/1974 Rocci ..... 343/765

*Primary Examiner*—Eli Lieberman

*Attorney, Agent, or Firm*—Brumbaugh, Graves, Donohue & Raymond

[57] ABSTRACT

A steerable antenna arrangement has a stator, a king post rotatable around an azimuth axis arranged in the stator, a rotating mechanism mounted on the king post, a four-point bearing accommodating the upper end of the king post, a tilting mechanism mounted on a horizontal elevation axis in the rotating mechanism, an antenna carried by the tilting mechanism, a cylindrical roller bearing with a conical inner race in the stator to accommodate the lower end of the king post, a running plane of the four-point bearing adjustable to the azimuth axis of the king post and fixable, adjustment means between the king post and the rotating mechanism for adjusting and fixing the elevation axis of the tilting mechanism relative to the azimuth axis of the king post, and anti-friction bearings with equal play, equal running out of true and equal installation position provided in the rotating mechanism and accommodating the elevation axis.

10 Claims, 4 Drawing Figures

STEERABLE ANTENNA ARRANGEMENT

The invention relates to a steerable antenna arrangement with a stator, a rotating mechanism mounted in the stator on a king post, wherein the upper end of the king post is mounted in a four-point bearing, and a tilting mechanism mounted on a horizontal axis in the rotating mechanism, which tilting mechanism carries an antenna.

Steerable antenna arrangements of this kind are used to watch celestial bodies, in particular telecommunication satellites and to receive signals from them or transmit signals to them. They must be capable of being adjusted with great precision to the movement of the celestial body, the maximum precision hitherto reached when locating the celestial body and following it lying in the range of approximately between 0.02° and 0.05°. Although with this precision it is possible to receive from or transmit to motionless celestial bodies or celestial bodies orbiting at low speeds, one tries to obtain a higher precision to make it possible to watch or receive from quickly orbiting satellites with a simultaneously increased receiving and transmitting capacity, to enable the transmission of a plurality of TV programs or of a plurality of simultaneous telephone connections, e.g.

According to the invention, this object is achieved with steerable antenna arrangements of the above defined kind in that the lower end of the king post is mounted without play in the stator in a cylindrical roller bearing having a conical inner race, that the running plane of the four-point bearing is adjustable to the azimuth axis of the king post and fixable, that the elevation axis of the tilting mechansim is adjustable relative to the azimuth axis of the king post by adjustment means between the king post and the rotating mechanism and fixable and that the elevation axis is mounted in the rotating mechanism in anti-friction bearings with equal play, equal running out of true and equal installation position. By this combination a precision in the adjustability to the movement of a celestial body of between 0.01° and 0.001° is obtained.

Preferably, the bearing body of the cylindrical roller bearing is provided with an annular flange and is displaceable and fixable in the horizontal plane relative to a counter-flange of the stator, which results in assembling advantages.

According to a further feature of the invention, the cylindrical roller bearing can be adjusted without play by a bracing disc, whereby the inner race is evenly widened over its periphery.

Suitably, the running plane of the four-point bearing is adjustable by pressure screws between the king post and the inner race of the bearing, which pressure screws and evenly distributed over the periphery of the bearing. Such pressure screws, in interaction with connection screws between the upper end of the king post and the inner race of the bearing are especially finely adjustable.

According to a preferred embodiment, the running plane of the four-point bearing can be fixable by filling the gap between the king post and the inner race of the bearing, whereby after an adjustment and fixing of the cylindrical roller bearing a close fit of the inner race of the bearing on the upper end of the king post is effected.

Also, pressure screws can be provided between the king post and the rotating mechanism, wherein the gap therebetween can be filled with a filling composition once the elevation axis has been adjusted perpendicularly to the azimuth axis. Here, too, a close fit of the rotating mechanism on the king post is effected.

According to an advantageous embodiment, the tilting mechanism is secured to the elevation axis without play, preferably by a tension ring connection. Thus an easy and quick mounting is obtained.

According to a further preferred embodiment of the present invention, the king post as well as the elevation axis are driven without play by two drives braced relative to each other, preferably toothed wheel drives.

An embodiment of the invention shall now be described by way of example only and with reference to the accompanying drawings, wherein.

Figure 1:
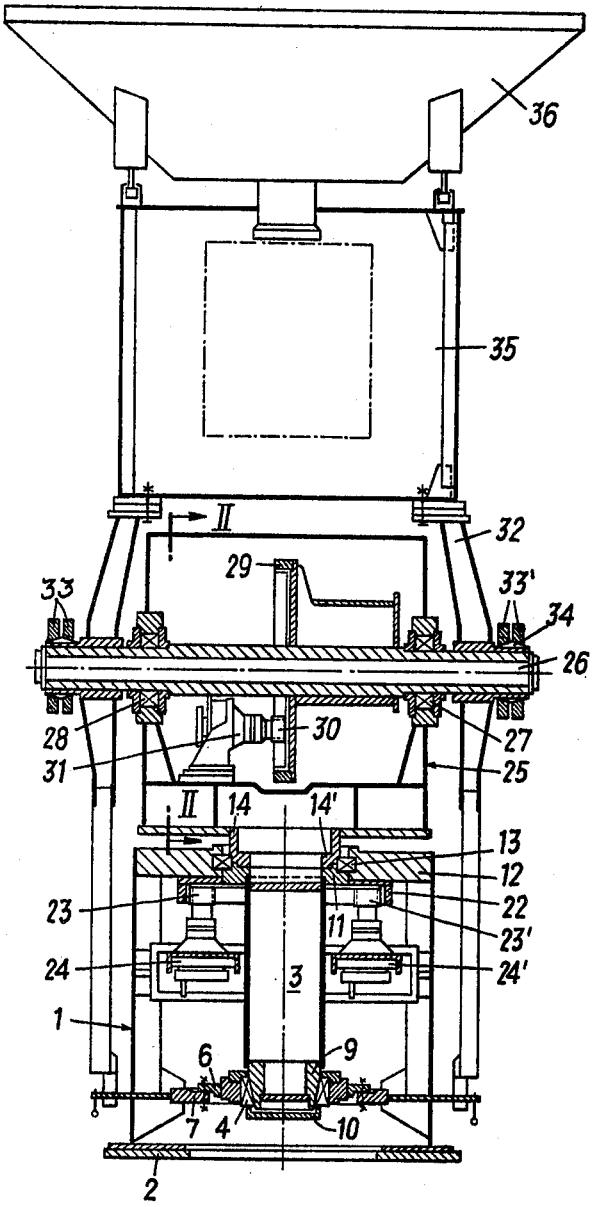
FIG. 1 is a side view, partly in section.

By 1 a stator is denoted, which is rigidly secured to a base 2. The lower end of the king post 3 is mounted with a cylindrical roller bearing 4 in the stator, wherein the bearing body 5 is provided with an annular flange 6, which can be connected with a counter-flange 7 of the stator via screws or the like. The inner race 8 of the bearing is conically designed and can be braced without play relative to a conically designed counter-face 9 of the king post by means of a bracing disc 10. The upper end 11 of the king post is connected with the ring 14' of the rotating mechanism 14 and mounted relative to the annular plate 12 of the stator by means of a four-point bearing 13. As can be seen, a gap 15 between the upper end 11 of the king post and the inner race 16 of the four-point bearing 13 and a gap 17 between the upper end 11 of the king post and the ring 14' of the rotating mechanism are present. Between the king post 11 and the inner race 16 of the four-point bearing 13, pressure and connecting screws 18 and 19 are provided, which are effective against each other. They serve in a manner to be described later on for adjusting the gap 15. In the same manner pressure and connecting screws 20 and 21 are provided for adjusting the gap 17 between the upper end 11 of the king post and the rotating mechanism 14. The upper part 11 of the king post is connected with a toothed ring 22 (see FIG. 1), into which toothed ring two pinions 23 and 23' engage. The two pinions are driven by the two drives 24 and 24' which are braced relative to each other, so that the toothed ring 22 can be rotated without play.

To the ring 14' of the rotating mechanism the housing 25 is secured, in which housing the horizontal or elevation axis 26 is mounted by means of the bearings 27 and 28. Advantageously, the bearings are designed as pendulum roller bearings. Since a deviation in the play, in the running out of true, and in the installation position of these two bearings is one of the main causes which have hitherto caused an inaccuracy of the angular adjustment of the antenna, according to the invention special emphasis has to be put on the selection of these bearings. This is effected in that bearings delivered by a factory are carefully experimentally tested as regards their play and their running out of true and two of them are selected which have the slightest, equal play possible and also qualitatively and quantitatively run as equally untrue as possible, i.e. that the eccentrical movement of their center when rolling off is the same. Two bearings selected according to these criteria, which thus are the closest in their properties, are then installed in equal positions.

Figure 2:
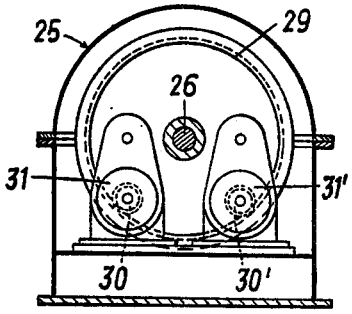
FIG. 2 is a section along line II-II of FIG. 1.
Figure 3:
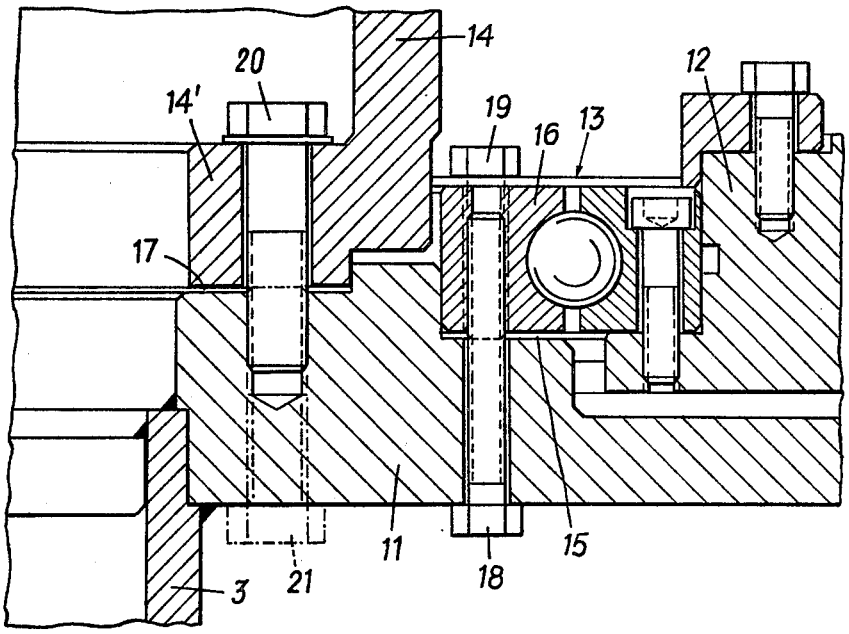
FIG. 3 is a detail of the connection of the four-point bearing with the king post on an enlarged scale.
Figure 4:
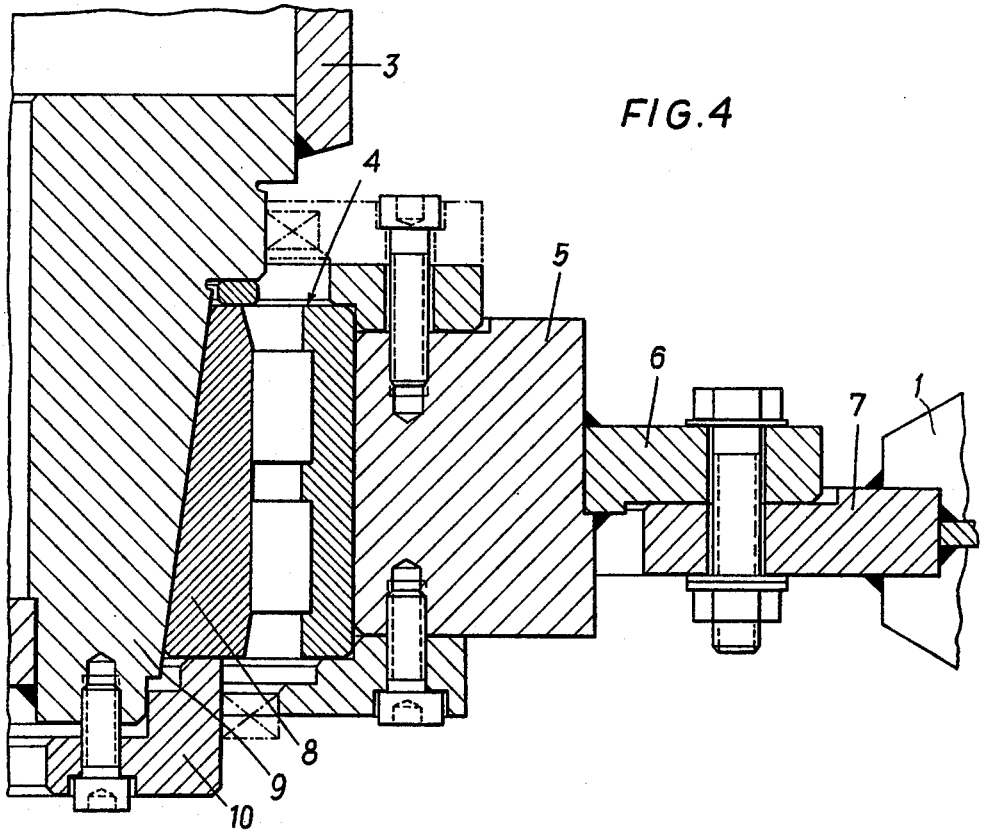
FIG. 4 illustrates the connection of the cylindrical roller bearing of the king post with the stator on an enlarged scale.

On the elevation axis 26, in a similar manner as on the azimuth axis, a toothed wheel 29 is mounted, into which toothed wheel two pinions 30 and 30' (see FIG. 2) engage, which are driven by two drives 31 and 31', which drives are braced relative to each other, so that also this drive is effected without play. Each support of the tilting mechanism 32 (see FIG. 1) is mounted by means of tension rings 33 and 33' and a cone 34 on the horizontal elevation axis without play. These supports carry a box 35 meant for accommodating electrical equipment; on the box 35 the reflector 36 is mounted.

The steerable antenna arrangement according to the invention is adjusted in the following manner:

When the king post has been installed in the stator, wherein, however, the flange connection 6, 7 remains open, the king post is driven and one looks if its lower end makes a wobbling movement. If an eccentricity occurs, the screws 18 and 19 are actuated until the eccentricity vanishes. Then the flange connection between the flanges 6 and 7 is produced by screwing and the gap 15 is filled with a filling composition. As next step the rotating and tilting mechanisms are mounted and a precise perpendicular adjustment of the horizontal elevation axis relative to the vertical azimuth axis of the king post running without an eccentricity is effected by an adjustment of the screws 20 and 21 and the gap 17 is filled with a filling composition.

The mounting of the tilting mechanism on the horizontal axis without play is finally effected by tensioning the conical tension rings 33.

What we claim is:

1. In a steerable antenna arrangement of the type including a stator, a king post with an upper end, a lower end, rotatable around an azimuth axis and arranged in the stator, a rotating mechanism mounted on the king post, a four-point bearing accommodating the upper end of the king post, a tilting mechanism mounted on a horizontal elevation axis in the rotating mechanism, and an antenna carried by said tilting mechanism, the improvement comprising in combination:

a. a cylindrical roller bearing with a conical inner race arranged in the stator and accommodating the lower end of the king post without play, b. a running plane of the four-point bearing which is adjustable to the azimuth axis of the king post and fixable, c. adjustment means provided between the king post and the rotating mechanism for adjusting and fixing the elevation axis of the tilting mechanism relative to the azimuth axis of the king post, and d. anti-friction bearings with equal play, equal running out of true and equal installation position provided in the rotating mechanism and accommodating the elevation axis.

2. A steerable antenna arrangement as set forth in claim 1, wherein the cylindrical roller bearing has a bearing body provided with an annular flange, a counter-flange being provided on the stator, the annular flange being displaceable and fixable relative to the counter-flange in the horizontal plane.

3. A steerable antenna arrangement as set forth in claim 1, further comprising a bracing disc for adjusting the cylindrical roller bearing without play.

4. A steerable antenna arrangement as set forth in claim 1, further comprising pressure screws provided between the king post and the inner race of the four-point bearing for adjustment of the running plane of the four-point bearing.

5. A steerable antenna arrangement as set forth in claim 4, wherein the running plane of the four-point bearing is fixable by filling a gap formed between the upper part of the king post and the inner race of the four-point bearing.

6. A steerable antenna arrangement as set forth in claim 1, wherein the adjustment means between the king post and the rotating mechanism are pressure screws, a gap formed therebetween being capable of being filled with a filling composition once the elevation axis has been adjusted perpendicularly to the azimuth axis.

7. A steerable antenna arrangement as set forth in claim 1, wherein the tilting mechanism is secured to the elevation axis without play.

8. A steerable antenna arrangement as set forth in claim 7, wherein the tilting mechanism is secured to the elevation axis by means of a tension ring connection.

9. A steerable antenna arrangement as set forth in claim 1, further comprising two drives braced relative to each other provided for each, the king post and the elevation axis, for driving the king post and the elevation axis without play.

10. A steerable antenna arrangement as set forth in claim 9, wherein said drives are toothed wheel drives.

* * * * *